US007882712B2

(12) United States Patent
Schaut et al.

(10) Patent No.: US 7,882,712 B2
(45) Date of Patent: Feb. 8, 2011

(54) CIRCULAR KNITTING MACHINE WITH A ROTATABLE BLADE FOR CUTTING A FABRIC TUBE

(75) Inventors: Bernhard Schaut, Albstadt (DE); Dietmar Traenkle, Balingen (DE)

(73) Assignee: SIPRA Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 12/336,888

(22) Filed: Dec. 17, 2008

(65) Prior Publication Data

US 2009/0158781 A1 Jun. 25, 2009

(30) Foreign Application Priority Data

Dec. 20, 2007 (DE) ..... 10 2007 063 339

(51) Int. Cl.
*D04B 35/34* (2006.01)

(52) U.S. Cl. ..... 66/151

(58) Field of Classification Search ..... 66/153, 66/151, 149 R, 152, 8
See application file for complete search history.

(56) References Cited

U.S. PATENT DOCUMENTS

| | | | | |
|---|---|---|---|---|
| 1,802,901 | A | 4/1931 | Arnold | |
| 3,855,822 | A | 12/1974 | Lee | |
| 4,314,462 | A * | 2/1982 | Ducol et al. | 66/152 |
| 5,566,558 | A * | 10/1996 | Tsuchiya | 66/151 |
| 6,568,221 | B2 * | 5/2003 | Seeger et al. | 66/8 |
| 6,640,590 | B2 * | 11/2003 | Thoman et al. | 66/153 |
| 2002/0157427 | A1 | 10/2002 | Seeger et al. | |
| 2002/0166347 | A1 | 11/2002 | Thoman et al. | |
| 2005/0229642 | A1 | 10/2005 | Lonati | |

FOREIGN PATENT DOCUMENTS

| | | |
|---|---|---|
| DE | 74 24 526 | 11/1974 |
| DE | 101 23 089 | 6/2002 |
| DE | 101 20 736 | 2/2003 |
| EP | 0 456 576 | 11/1991 |
| WO | 00/50678 | 8/2000 |

* cited by examiner

*Primary Examiner*—Danny Worrell
(74) *Attorney, Agent, or Firm*—Michael J. Striker

(57) ABSTRACT

A circular knitting machine for the production of an opened fabric tube comprises a needle cylinder (1), a frame (6), which is coupled to the needle cylinder (1) and in which at least a draw-off roller (4) and/or a take-up roller (5), drive means (36 to 43) to drive said roller, and a blade (19) intended for opening the fabric tube are each rotatably mounted, and a flexible shaft (21), which is rigidly connected to the blade (19) and a drive wheel (38), for setting the blade (19) in rotation at a rotational speed dependent on the knitting speed. According to the invention, the drive wheel (38) of the flexible shaft (21) is functionally connected (FIG. 2) to the drive means (36 to 43) for the draw-off and/or take-up roller (4, 5).

6 Claims, 5 Drawing Sheets

CIRCULAR KNITTING MACHINE WITH A ROTATABLE BLADE FOR CUTTING A FABRIC TUBE

CROSS-REFERENCE TO A RELATED APPLICATION

The invention described and claimed hereinbelow is also described in German Patent Application DE 10 2007 063 339.6 filed on Dec. 20, 2007. This German Patent Application, whose subject matter is incorporated here by reference, provides the basis for a claim of priority of invention under 35 U.S.C. 119(a)-(d).

FIELD OF THE INVENTION

The invention relates to a circular knitting machine for the production of an opened fabric tube, comprising: a needle cylinder, a frame in which at least a draw-off roller and/or a take-up roller, drive means to drive said roller and a blade for opening the fabric tube by cutting are each rotatably mounted, and a flexible shaft which is rigidly connected to the blade and a drive wheel for setting the blade in rotation at a rotational speed dependent on a knitting speed.

BACKGROUND OF THE INVENTION

A known circular knitting machine of this type (DE-Gbm 74 24 526) is provided with a rotatable blade, which is for the purpose of unraveling (cutting) the fabric tube, produced by the circular knitting machine, either between two stitch wales or in the region of what is known as a change point (changing zone), within which the threads forming the fabric tube are processed not to form stitches, but only to form float stitches. In order for the blade to be able to be installed in a simple manner in various types of machines and to be adjusted easily in terms of the position thereof relative to the fabric tube, said blade is connected to one end of a flexible shaft, the other end of which is provided with a drive wheel, which rolls on the underneath of a stationary carrier ring when the needle cylinder rotates. In this way, the flexible shaft, and with said shaft also the blade, are automatically set in rotation when the needle cylinder rotates.

In the known circular knitting machine, the drive wheel of the flexible shaft may also be formed as a friction wheel or as a toothed wheel. The construction as a friction wheel has the disadvantage that varying rotational speeds for the blade may result because of slipping or wear. As long as the fabric tube is to be cut in the region of float stitches, this is not a major problem. By contrast, if the fabric tube is to be cut along regions in which there is a conventional stitch formation, unclean or incorrect cutting edges may result, in particular at rotational speeds of the blade which are lower than corresponds to the speed of drawing-down the fabric tube. This is particularly undesirable in relation to circular knitting machines of which the draw-off and/or take-up rollers are provided with means for opening and stretching out the cut fabric tube so as to be able to draw off and/or take up a single-layered fabric with twice the width of the fabric tube (for example EP 0 456 576 B1, PCT WO 00/50678, DE 101 20 736 C1). By contrast, if the drive wheel of the flexible shaft is formed as a toothed wheel, then it is ensured that the blade always rotates at a pre-selected rotational speed. In this case, however, the stationary carrier ring would have to be provided with a circular toothed ring, and this involves considerable expense. Moreover, in both cases, it is difficult to access the drive wheel and it is thus difficult individually to adjust the rotational speed of the blade as a function of the speed at which the fabric tube is produced, or to replace the drive wheel.

In circular knitting machines of this last type, it is therefore conventional for the blade to be driven by a separate motor, which is in fact also arranged at an inaccessible location in the machine frame, but which can be set to different rotational speeds from the outside using electrical means. However, motors of this type increase the construction expenses and make exact positioning of the blade more difficult. In comparison therewith, the use of a flexible shaft would have advantages.

SUMMARY OF THE INVENTION

Starting from the above, an object underlying the present invention is to design the circular knitting machine in such a way that the flexible shaft is driven at a constant, pre-selected speed.

A further objection of the invention is to design the circular knitting machine in such a way that the rotational speed of the flexible shaft can be adjusted in a simple manner.

Yet another object of the invention is to drive the flexible shaft at a constant, pre-selected rotational speed without the need for providing carrier rings or the like of the circular knitting machine with toothed rings.

These and other objects of the invention are solved by functionally connecting the drive wheel of the flexible shaft to the drive means for the draw-off and/or take-up roller.

The invention has the advantage that the drive wheel of the flexible shaft is connected at an appropriate location to the drive means, which are already present under the needle cylinder and which are intended to drive the draw-off and/or take-up rollers. Said shaft is therefore driven independently of carrier rings which are attached to the machine frame of the circular knitting machine, and the carrier rings do not need to be configured with any regard to the drive wheel of the flexible shaft.

In this way, the overall construction is substantially simplified. Furthermore, the drive wheel of the flexible shaft can be readily provided in an easily accessible location, and can therefore be replaced easily when required. Additional drives for the blade are not required.

Further advantageous features of the invention will emerge from the dependent claims.

BRIEF DESCRIPTION OF THE DRAWINGS

In the following, the invention will be explained in greater detail with respect to an embodiment in relation to the appended drawings, in which.

DESCRIPTION OF THE PREFERRED EMBODIMENTS

Figure 1:
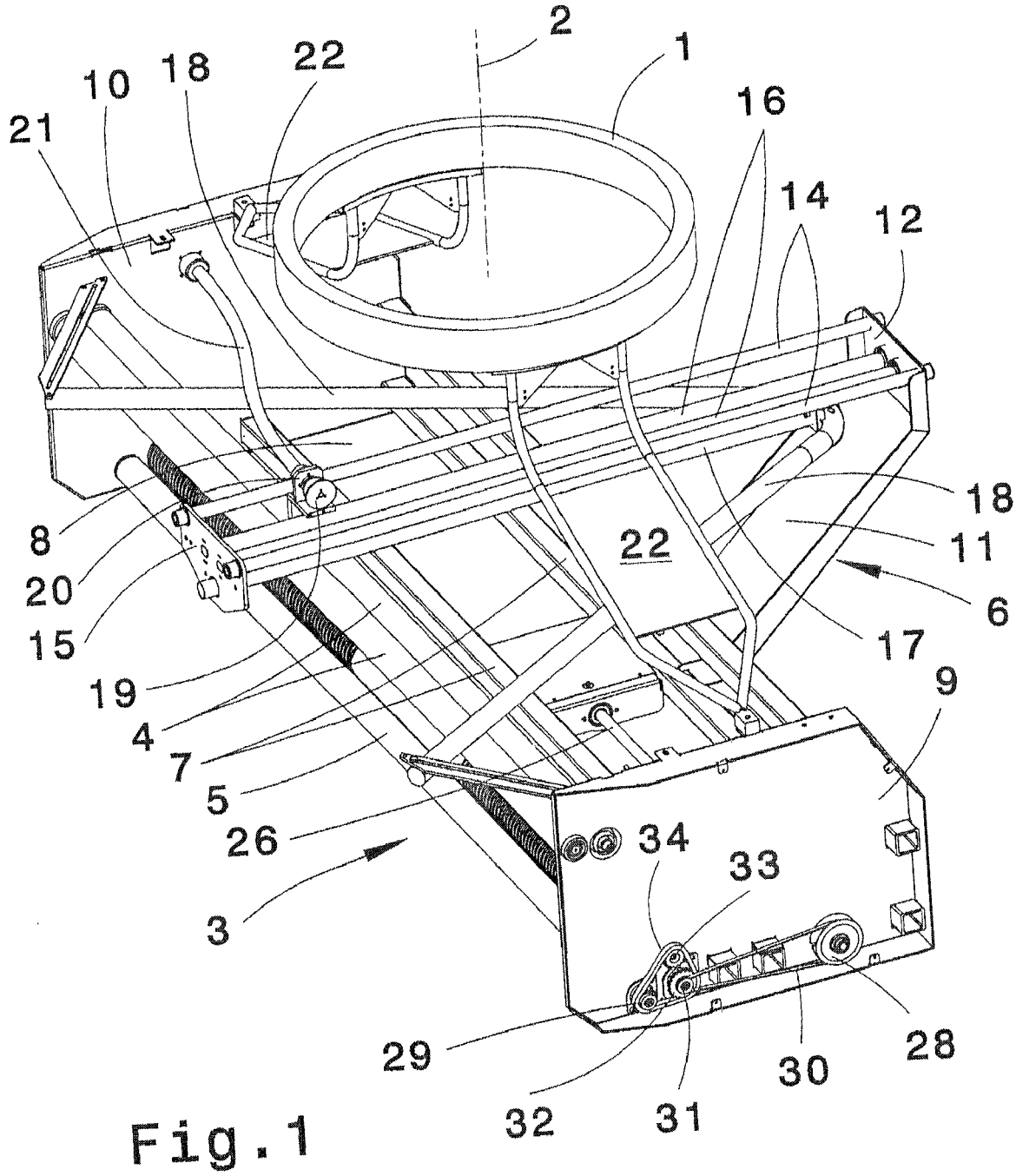
FIG. 1 is a schematic, perspective view of a circular knitting machine with a flexible shaft driven according to the invention, a draw-off and/or take-up means being located in a first rotational position.
Figure 2:
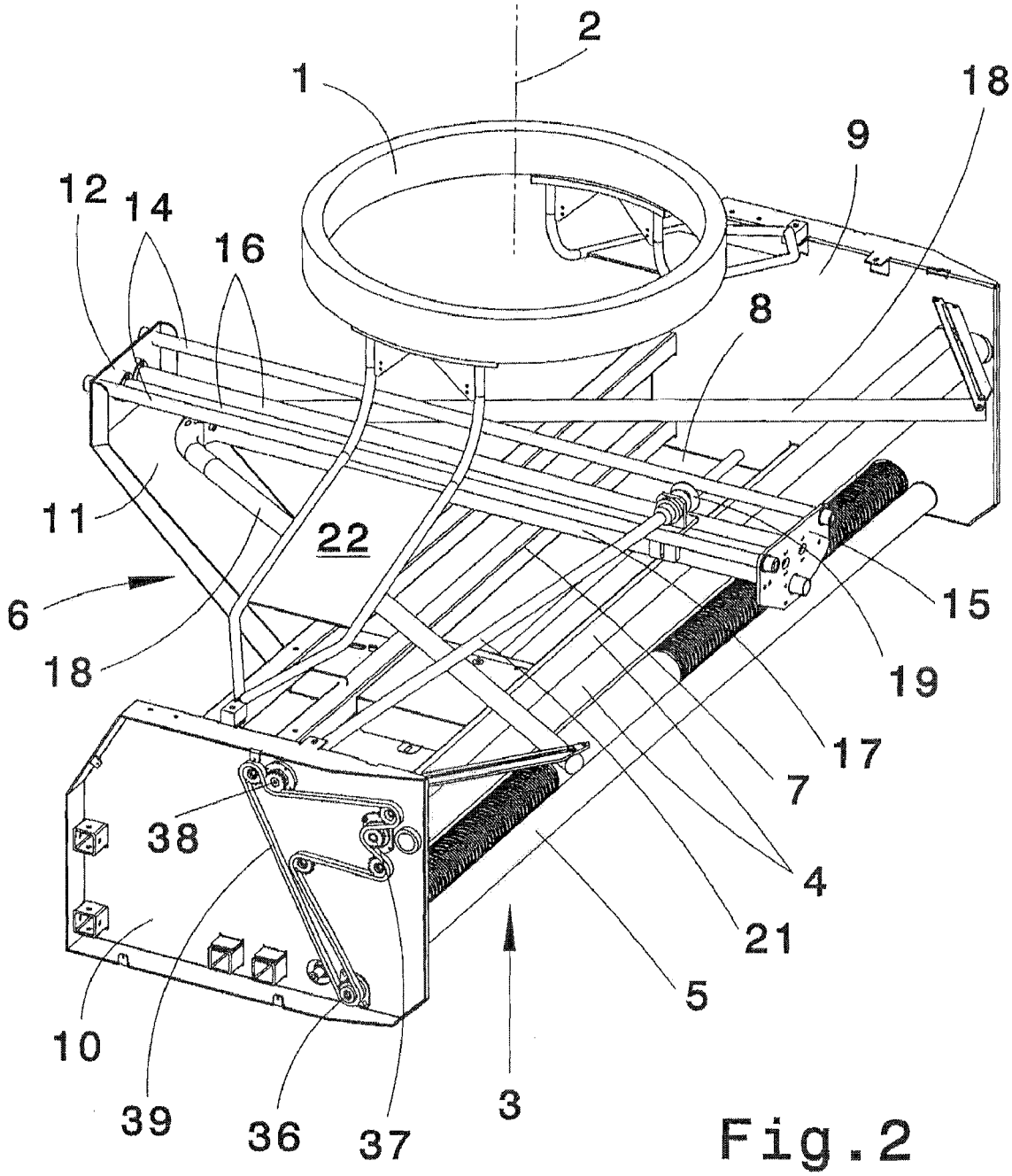
FIG. 2 is a schematic view corresponding to FIG. 1, the draw-off and/or take-up means, however, being located in a second rotational position.

FIGS. 1 and 2 show only those components of a circular knitting machine necessary for an understanding of the invention, which is constructed substantially in the manner shown in DE 101 20 736 C1 and DE 101 23 089 C1, in such a way that further explanations for the person skilled in the art can be omitted.

In FIGS. 1 and 2, a schematically shown needle cylinder 1 is mounted so as to be rotatable about a machine axis 2 in a machine frame (not shown), which is supported on feet, and is connected to a drive which is likewise arranged in the machine frame. The machine frame is provided near to the base thereof with a lower, stationary carrier ring, which is to be described later with reference to FIG. 3 and on which a draw-off and/or take-up means, generally denoted by the reference numeral 3, is mounted so as to be rotatable about the machine axis 2. The draw-off and/or take-up means 3 serves to pull a fabric tube produced by the circular knitting machine off the needle cylinder 1 and/or to wind said fabric tube. In this case, it is not important for the purposes of the invention whether the draw-off and/or take-up means contains only at least one draw-off roller 4 or only a take-up roller 5 or both, in order only to pull off, only to wind on and/or to pull off and to wind on the fabric tube, as is generally known to the person skilled in the art. In the embodiment, two draw-off rollers 4 and also a take-up roller 5 are present.

The draw-off and/or take-up means 3 further contains a frame 6, which is rotatably mounted on the lower carrier ring, and which for example is formed substantially from two side walls 9 and 10, which are connected by rods 7 and a base 8 and are arranged at a distance from one another, and an arm 11 arranged perpendicular to the rods 7. The two draw-off rollers 4 and the take-up roller 5 are arranged between the side walls 9, 10 and mounted rotatably therein by their ends. The arm 11 is provided in an upper portion thereof with a support plate 12, to which is fastened one end of each of two connection rods 14 which extend perpendicular to the two rollers 4 and 5 and are parallel to one another. The opposite ends of the connection rods 14 are connected by a further support plate 15. The two support plates 12, 15 and the connection rods 14 form a support framework for two guide rods 16, which are arranged parallel to the connection rods 14 and are mounted by their ends rotatably in or rigidly on the support plates 12 and 15, and the length of which is somewhat greater than the width of the fabric tube drawn off the needle cylinder 1 in the two-layer state thereof. Moreover, a carrier rod 17, which is likewise arranged parallel to the connection rods 14 and below the articulated rods 16, is fastened to the support plate 15 of the described support framework, extends into the vicinity of the opposite support plate 12, and has mounted at the free end thereof two rods or rollers 18, which are arranged in a V shape and are connected rigidly or rotatably to the carrier rod 17.

Furthermore, a rotatable blade 19, for example constructed as a roller blade, is arranged in the frame 6 at a point close to the support plate 15, between and directly above the guide rods 16 and is mounted on a support 20 in such a way as to be rotatable, and adjustable as required. The support 20 is for example fastened so as to be displaceable and lockable in position on one of the connection rods 14. According to FIGS. 1 and 2, the blade 19 is rigidly connected to one end of a shaft 21, which acts to set the blade 19 in a rotational motion. The blade 19 generally rotates in the direction in which the fabric is drawn off, because in the case of a rotation opposed to the draw-off direction, there is a risk of the knitted fabric being hooked in the blade 19 and pulled along thereby.

Finally, it should also be mentioned that the needle cylinder 1 is connected in terms of drive to the frame 6, for example to the side walls 9 and 10 thereof, by entrainment means 22. Rotation of the needle cylinder 1 therefore results also in rotation of the entire draw-off and/or take-up means 3 together with the needle cylinder 1 about the machine axis 2.

In the operation of the described, in this respect known, circular knitting machine (DE 101 20 736 C1, DE 101 23 089 C1), the fabric tube coming from the rotating needle cylinder 1 is initially folded into two parallel layers and drawn through the two guide rods 16, said fabric tube then being opened along a line parallel to the stitch wales thereof by the rotating blade 19. Immediately afterwards, the opened portion of the fabric tube reaches the region of the rollers 18, which are arranged in a V shape, and by which said portion is gradually spread out until it forms, upon reaching the free ends of the rollers 18, a single-layer, substantially planar web, the width of which is twice as great as that of the two-layered portion held by the guide rods 16. Subsequently, the single-layered fabric web reaches the region of the driven draw-off roller 4, which pulls off the fabric tube at the production speed pre-specified by the circular knitting machine, and is then wound up by the likewise driven take-up roller 5. Furthermore, this mode of operation can be achieved independently of whether the needle cylinder 1, and together therewith the entire draw-off and/or take-up means 3, or a cam box ring, which surrounds the needle cylinder 1 and acts on knitting needles or the like, and associated components, are rotated about the machine axis 2 while the needle cylinder 1 and the draw-off and/or take-up means 3 remain stationary.

Figure 3:
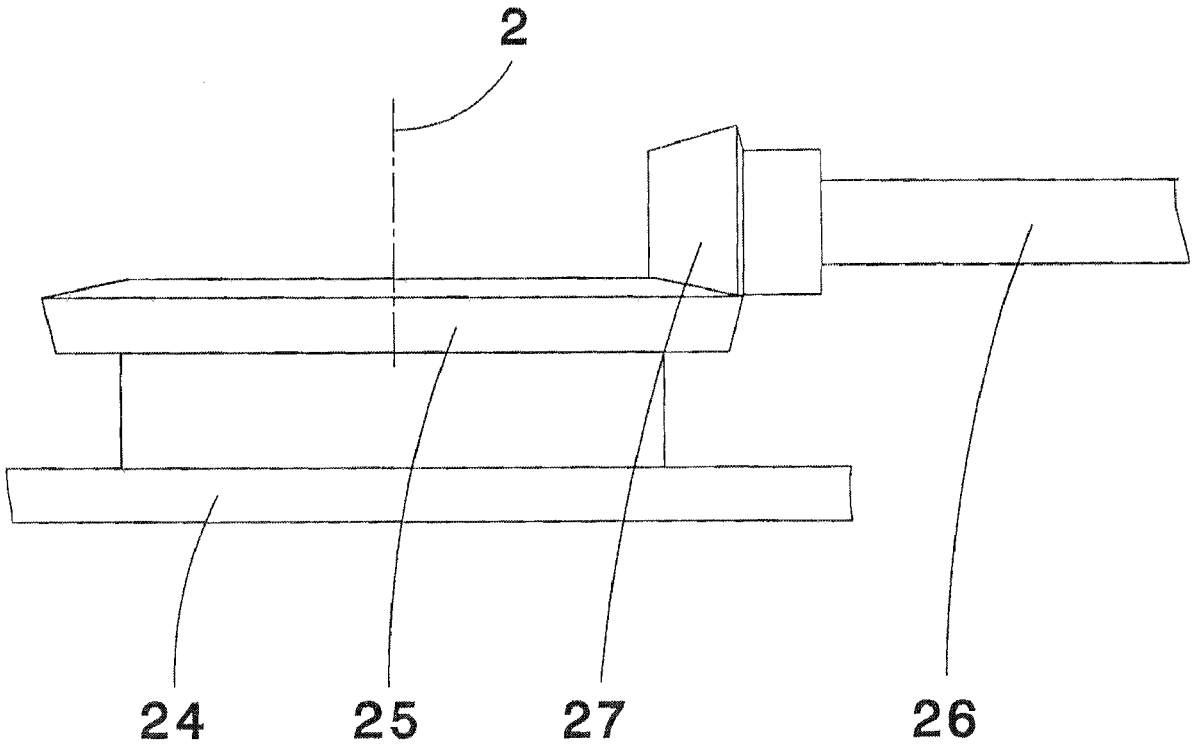
FIG. 3 is a schematic view of a drive shaft for the draw-off and/or take-up means according to FIGS. 1 and 2.

A stationary carrier ring 24, which is arranged on the base of the machine frame and is shown only schematically in FIG. 3, and to which an also stationary bevelled wheel 25 is fastened, generally serves to drive the various components. In the frame 6, which is rotatably mounted on the carrier ring 24, a drive shaft 26 is rotatably mounted, which is also visible in FIG. 1, and to which a bevel pinion 27 is fastened, which is engaged with the bevelled wheel 25. When the frame 6 rotates about the machine axis 2, the bevel pinion 27 rolls on the bevelled wheel 25, causing the drive shaft 26 to be set in rotation about its own axis in addition to the circular motion at a pre-selected rotational speed. If required, a transmission, in particular an adjustable transmission, may be provided between the bevelled wheel 25 and the bevel pinion 27, in order to be able to adjust the rotational speed of the drive shaft 26 relative to the circulation speed of the frame 6.

Figure 4:
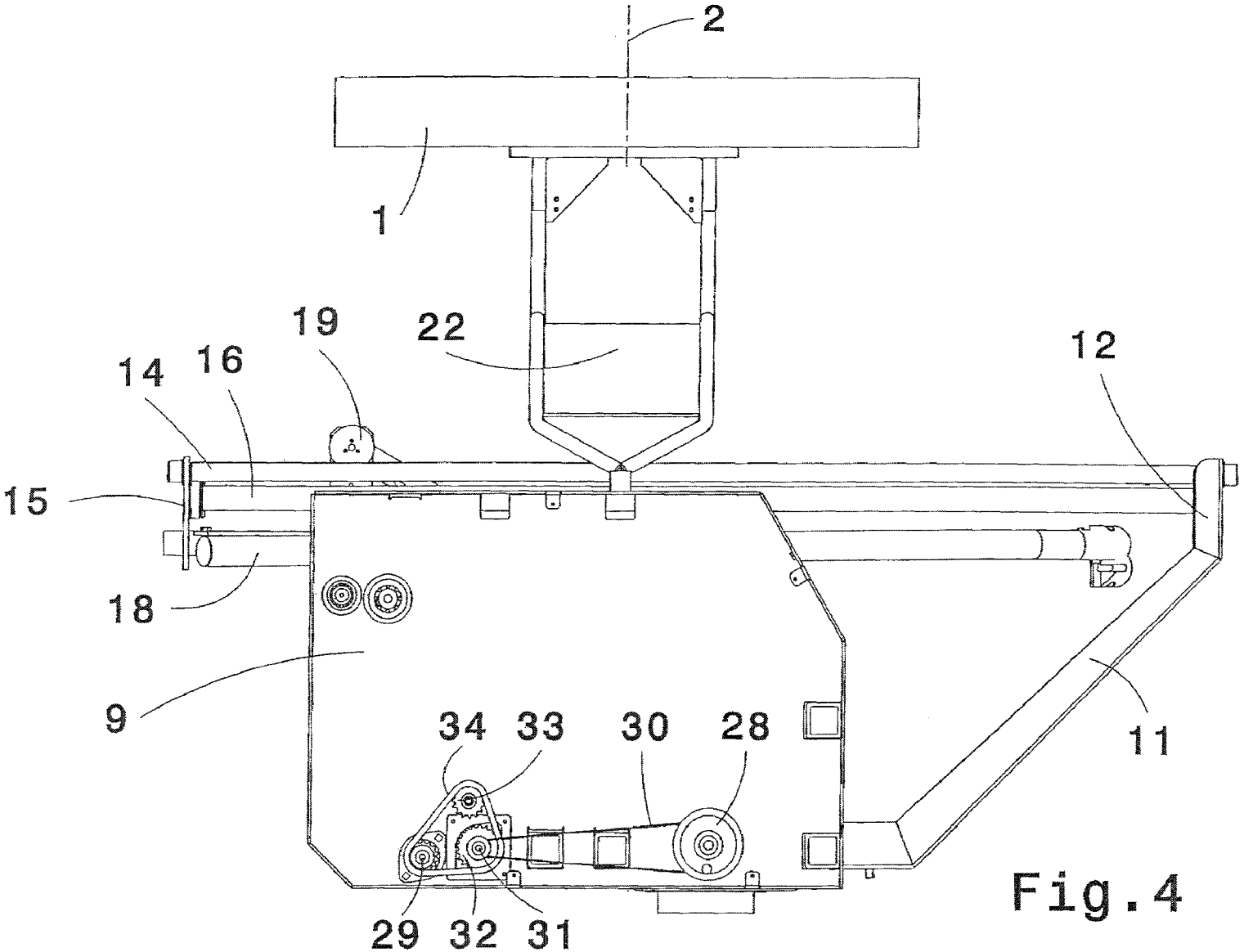
FIG. 4 is an enlarged front view of a first side wall, visible in FIG. 1, of a frame of the draw-off and/or take-up means.

According to FIGS. 1 and 4, one end of the take-up roller 5 and one end of the drive shaft 26 are rotatably mounted in the side wall 9, the one being rigidly connected to a wheel 28 and the other one being rigidly connected to a wheel 29. Both wheels 28, 29 are arranged on the outside of the side wall 9. The two wheels 28, 29 may be directly connected by an endless drive element which lies on the circumference of the wheels 28, 29. In the embodiment, by contrast, an indirect connection is provided in that an endless drive element 30 lies on the circumference of the wheel 28 and of an intermediate wheel 31, which is mounted rotatably in the side wall 9 and is connected to the wheel 29 of the take-up roller 5 via a wheel 32 which is coaxial therewith, a guide wheel 33, and a further endless drive element 34.

In the embodiment, each of the wheels 28, 29, 31, 32 and 33 is a belt pulley, whilst the drive elements 30, 34 consist of belts lying thereon. The described arrangement consisting of the components 28 to 34 further forms drive means, arranged on the outside of the side wall 9, in the form of a first belt drive, which drives the take-up roller 5 at a rotational speed which is synchronous with the needle cylinder rotation.

Figure 5:
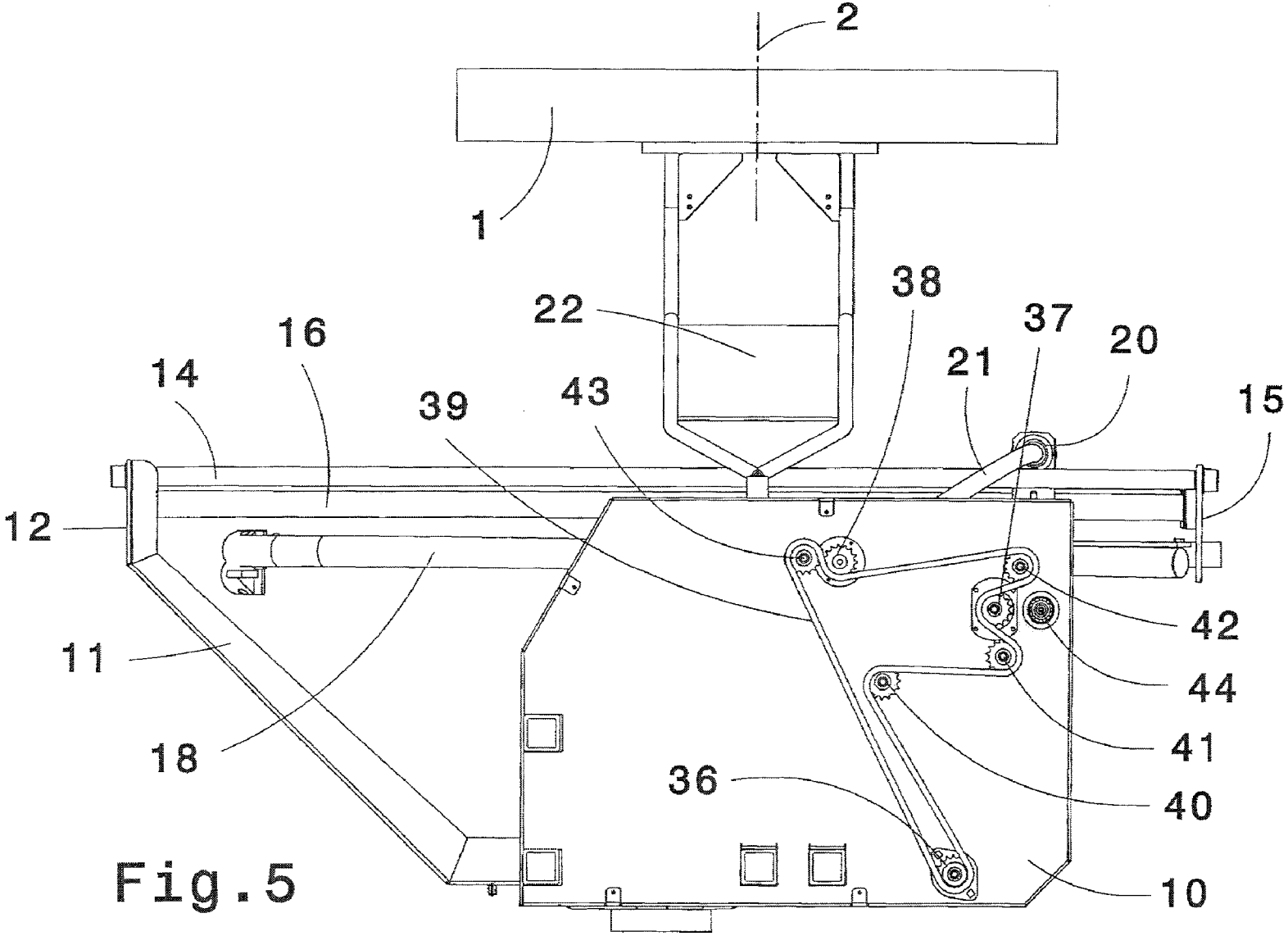
FIG. 5 is an enlarged front view of a second side wall, visible in FIG. 2, of the frame of the draw-off and/or take-up means.

According to FIGS. 2 and 5, a wheel 36, arranged on the outside of the side wall 10, is fastened to one end, which is rotatably mounted in the opposite side wall 10, of the take-up roller 5. In a corresponding manner, a wheel 37 is fastened to one end, which is rotatably mounted in the side wall 10, of one of the draw-off rollers 4. A further drive wheel 38 which is rotatably mounted on the outside of the side wall 10 is fastened to an end of the shaft 21 remote from the blade 19, the shaft 21 of the circular knitting machine of the present invention being designed as a flexible shaft. The three wheels 36, 37 and 38 are connected in terms of drive by an endless drive element 39 which loops around them at least in part. The drive element 39 preferably also extends over guide wheels 40 to 43, the positions of which are selected in such a way that the drive element 39 lies on the wheels 36, 37 and 38 at a sufficiently large wrap angle, and at least one of which, for example the guide wheel 33 (FIG. 4), can simultaneously be used to tension the drive element 39.

In FIG. 5, the reference numeral 44 shows the bearing of the second draw-off roller 4, which is entrained, as is conventional, by a frictional connection to the driven draw-off roller 4 or to the fabric located in the gap between two draw-off rollers 4.

In the embodiment, the wheels 36 to 38 and 40 to 43 are each formed as a belt pulley, whilst the drive element 39 consists of a belt lying thereon. The described arrangement consisting of the parts 36 to 43 moreover forms a second belt drive, which is arranged on the outside of the wall 10 and drives one draw-off roller 4 and the flexible shaft 21, which is visible in FIG. 2, each at a rotational speed which is synchronous with the needle cylinder rotation, when the drive shaft 26 and thereby the take-up roller 5 are rotated. The draw-off rollers 4, the take-up roller 5 and the flexible shaft 21 are thus driven at rotational speeds which depend on the knitting speed at which the fabric tube is produced.

It is significant for the purposes of the invention that only the drive wheel 38 and optionally the guide wheel 43 are required to drive the flexible shaft 21, because the remaining parts of the second belt drive are already present in any case. This results in an extremely low-priced construction. Furthermore, the drive wheel 38 can be arranged at an easily accessible point on the side wall 10. If the drive wheel 38 is finally fastened to the flexible shaft 21 with a set screw or the like so as to be easily releasable, then said drive wheel can also easily be exchanged for another drive wheel 38, if a different rotational speed for the blade 19 is desired depending on the knitted fabric to be produced.

The transmission ratios are preferably selected in such a way that the blade 19 always rotates at a circumferential speed which is somewhat higher than the draw-off speed of the fabric tube. This ensures a flawless cutting line.

The invention is not limited to the disclosed embodiment, which can be modified in numerous ways. In particular, it is clear that the disclosed belt drives may also be formed as chain drives, by forming the various wheels as chain wheels and the drive elements 30, 34 and 39 as chains, in which case the belt drives are replaced by chain drives. However, it may alternatively also be provided that the wheels 28, 29, 31 to 33, 36 to 38 and 40 to 43 are formed as toothed wheels as shown, and the drive elements 30, 34 and 39 are formed as inwardly toothed belts in engagement therewith, and this is currently considered to be the best solution. Further, the disclosed drive for the flexible shaft 21 with the drive shaft 26, the first belt drive, the take-up roller 5 and the second belt drive represents only one practical embodiment. In fact, both belt drives could for example be arranged on one of the two side walls 9 or 10 and then also be replaced by a single belt drive. Further, the drive wheel 38 of the flexible shaft 21 could be coupled to the drive means (first belt drive of FIG. 4) for the take-up roller 5. Further, instead of the belt or chain drives, drive means consisting of engaged toothed wheels could also be provided. In this respect, it is significant for the purposes of the invention only that the drive element 38 of the flexible shaft 21 is functionally connected to the drive means which act to drive the draw-off and/or take-up roller, in such a way that no additional components need be provided on the circular knitting machine. Finally, it is understood that the various features may also be used in different combinations from those disclosed and illustrated.

It will be understood, that each of the elements described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. Circular knitting machine for the production of an opened fabric tube, comprising: a needle cylinder (1), a frame (6) in which at least a draw-off roller (4) and/or a take-up roller (5), drive means (28 to 34; 36 to 43) to drive said draw-off roller and/or take-up roller and a blade (19) for opening the fabric tube by cutting are each rotatably mounted, and a flexible shaft (21), which is rigidly connected to said blade (19) and a drive wheel (38), for setting said blade (19) in rotation at a rotational speed dependent on a knitting speed, wherein said drive wheel (38) of said flexible shaft (21) is directly connected to said drive means (28 to 34; 36 to 43) for said draw-off and/or take-up roller (4, 5) without being directly connected to and controlled by said draw-off and/or take-up roller (4, 5).

2. Circular knitting machine according to claim 1, wherein said drive means (28 to 34; 36 to 43) comprise a chain or belt drive and wherein said drive wheel (38) of said flexible shaft (21) is directly connected to said chain or belt drive without being directly connected to and controlled by said draw-off and/or take-up roller (4, 5).

3. Circular knitting machine according to claim 2 and further comprising a take-up roller (5) and a draw-off roller (4), said take-up roller (5) being functionally connected to a drive shaft (26) via a first chain or belt drive (28 to 34) and to said draw-off roller (4) and said drive wheel (38) of said flexible shaft (21) via a second belt drive (36 to 43).

4. Circular knitting machine according to claim 3, wherein said take-up roller (5) comprises at one end a first wheel (29) which is connected to said first chain or belt drive (28 to 34) and at an other end a second wheel (36) which is connected to said second chain or belt drive (36 to 43).

5. Circular knitting machine according claim 1 and further comprising a means (17, 18) for spreading out said fabric tube opened by cutting with said blade (19), wherein the means for spreading out is arranged between said needle cylinder (1) and said draw-off and/or take-up roller (4, 5).

6. Circular knitting machine according to claim 1, wherein said drive means for said draw-off and/or take-up roller (4, 5) include a drive element (37, 36) connected with said draw-off and/or take-up roller (4, 5), wherein said drive wheel (38) of said flexible shaft (21) of said blade (19) is directly connected with said drive element (37, 36) of said drive means of said draw-off and/or take-up roller (4, 5) without being directly connected to and controlled by said draw-off and/or take-up roller (4, 5).

* * * * *